US009409680B2

(12) United States Patent
van Alfen et al.

(10) Patent No.: US 9,409,680 B2
(45) Date of Patent: Aug. 9, 2016

(54) TAMPER EVIDENT CLOSURE

(71) Applicant: PLASTICUM NETHERLANDS B.V., Tilburg (NL)

(72) Inventors: Jan van Alfen, Nijmegen (NL); Shi Ming Pun, Arnhem (NL); Sebastiaan Wilhelmus Josephus den Boer, Twello (NL); Gerrit Jan Stegeman, Lochem (NL)

(73) Assignee: Plasticum Netherlands B.V., Tilburg (NL)

( * ) Notice: Subject to any disclaimer, the term of this patent is extended or adjusted under 35 U.S.C. 154(b) by 48 days.

(21) Appl. No.: 14/357,665

(22) PCT Filed: Nov. 13, 2012

(86) PCT No.: PCT/NL2012/050803

§ 371 (c)(1),
(2) Date: May 13, 2014

(87) PCT Pub. No.: WO2013/077733

PCT Pub. Date: May 30, 2013

(65) Prior Publication Data

US 2015/0166225 A1 Jun. 18, 2015

(30) Foreign Application Priority Data

Nov. 22, 2011 (NL) ..... 2007839

(51) Int. Cl.
*B65D 41/46* (2006.01)
*B65D 41/32* (2006.01)
(Continued)

(52) U.S. Cl.
CPC ..... *B65D 41/32* (2013.01); *B65D 47/06* (2013.01); *B65D 47/08* (2013.01); *B65D 2101/0023* (2013.01); *B65D 2101/0053* (2013.01)

(58) Field of Classification Search
CPC ..... B65D 41/3428; B65D 41/3404; B65D 41/3442; B65D 41/3447; B65D 41/0471; B65D 47/06; B65D 47/08; B65D 2101/023; B65D 2101/0053
USPC ..... 220/266, 288; 215/252, 250, 330
See application file for complete search history.

(56) References Cited

U.S. PATENT DOCUMENTS 3,407,976 A 10/1968 Homma
4,638,917 A 1/1987 Persch
(Continued)

FOREIGN PATENT DOCUMENTS

DE 3421820 A1 12/1985
EP 1174359 A2 1/2002
JP 2010-235167 A 10/2010

OTHER PUBLICATIONS

English machine translation of EP 1174359 A2.
(Continued)

*Primary Examiner* — J. Gregory Pickett
*Assistant Examiner* — Niki M Eloshway
(74) *Attorney, Agent, or Firm* — Hoffmann & Baron, LLP

(57) ABSTRACT

A tamper-evident dispensing closure includes a body adapted to be attached to a container. The container has a shoulder portion surrounding a dispensing opening. The closure body has a peripheral wall and a top wall which extends over one end of the peripheral wall, such that the corresponding end of the body is closed off by the top wall and an opposite end of the body is open. The open end is in use placed over the shoulder portion of the container. The top wall is provided with a dispensing passage which in use is in line with the dispensing opening of the container. The peripheral wall is provided with tamper-evident means, which cause the peripheral wall to rupture when the closure is removed from the container, thereby indicating tampering.

16 Claims, 3 Drawing Sheets

(51) Int. Cl.

| | |
|---|---|
| ***B65D 47/06*** | (2006.01) |
| ***B65D 47/08*** | (2006.01) |
| *B65D 43/16* | (2006.01) |

(56) References Cited

U.S. PATENT DOCUMENTS 4,967,920 A * 11/1990 Dahl ..... B65D 41/3447 215/252
4,986,430 A * 1/1991 Dutt ..... B65D 41/3447 215/216
5,020,682 A 6/1991 Dutt
5,105,960 A * 4/1992 Crisci ..... B65D 41/3409 215/217
5,186,369 A 2/1993 Aguirrezabal
5,456,376 A * 10/1995 Luch ..... B65D 1/023 215/256
5,593,055 A * 1/1997 Repp ..... B65D 1/023 215/256
5,687,866 A * 11/1997 Luch ..... B65D 1/023 215/256
5,909,827 A 6/1999 Bietzer et al.
6,047,840 A * 4/2000 Moore ..... B65D 41/0471 215/330
6,112,923 A * 9/2000 Ma ..... B65D 41/3428 215/252
7,527,159 B2 * 5/2009 Brozell ..... B65D 41/0471 215/222
8,256,632 B2 * 9/2012 Andersson ..... B29C 45/14598 215/252
2007/0034591 A1 2/2007 Flak, Jr. et al.

OTHER PUBLICATIONS

English machine translation of abstract and claim 1 of DE 3421820 A1.

* cited by examiner

TAMPER EVIDENT CLOSURE

CROSS-REFERENCE TO RELATED APPLICATIONS

This application is the National Stage of International Application No. PCT/NL2012/050803 filed Nov. 13, 2012, which claims the benefit of Netherlands Application No. NL 2007839, filed Nov. 22, 2011, the contents of which is incorporated by reference herein.

BACKGROUND OF THE INVENTION

The present invention relates to a tamper-evident dispensing closure comprising a body adapted to be attached to a container. The container has a shoulder portion surrounding a dispensing opening. The closure body has a top wall and a peripheral wall which extends from the top wall towards a lower end, such that said lower end of the peripheral wall defines an open end of the body. The open end of the body is in use placed over the shoulder portion of the container. The top wall is provided with a dispensing passage which in use is in line with the dispensing opening of the container. The peripheral wall is provided with tamper-evident means, which cause the peripheral wall to rupture when the closure is removed from the container, thereby indicating tampering with the closure.

The invention thus proposes to provide a closure of which the structural integrity is destroyed when the closure is removed from the container, thereby indicating that the container-closure assembly has been tampered with.

SUMMARY OF THE INVENTION

According to the invention the peripheral wall of the closure body has on its inner side one or more protrusions that project inwardly, which protrusions are adapted to be, at least partially, received in corresponding recesses in the shoulder portion of the container, wherein the peripheral wall on the inner side next to at least one of the protrusions is provided with a weakening line. In this embodiment the protrusions on the inner side of the closure body and the recesses cooperate to block the rotation of the closure with respect to the shoulder of the container. If in an attempt to remove the closure from the container a certain rotational force is applied to the closure, the protrusions which are held by the recesses will cause such a tension in the material that the peripheral wall will rupture at the location of the weakening line. Thereby an inerasable indication is left on the closure that an attempt is made to tamper with the container-closure assembly.

In a possible embodiment the one or more protrusions are formed as ribs which extend from the open end towards the top wall of the closure body, a lower portion of the ribs being adapted to be received in said corresponding recesses in the shoulder portion of the container.

In a further possible embodiment the weakening line is a groove on the inner surface of the peripheral wall, preferably a groove which has substantially a V-shape. In case the protrusion is a rib which extends from the open end towards the top wall of the closure body, the groove preferably extends along at least a substantial part of the length of the rib.

In a possible embodiment the ribs have a first portion that is substantially perpendicular with respect to the peripheral wall and a second portion that is bent away from the first portion. Preferably the groove is provided at that side of the rib to which also the second rib portion bends away. Also preferably the ribs have an end edge which forms an abutment surface for abutting against a stop surface at the recess in the shoulder of the container. In this preferred embodiment the attempted rotation of the closure body with respect to the shoulder of the container pushes the abutment surface against a wall of the recess in the shoulder. As the groove is on the same side to which the second portion is bent, the rotational force will open up the groove even more, which eventually causes the peripheral wall at the groove to be torn towards the outer side of the peripheral wall.

Preferably, the second portion extends in an angle with respect to the first portion between 90° and 180°, preferably of about 120°. In a further preferred embodiment the peripheral wall is provided with four ribs, consisting of two pairs of diametrically opposite ribs with respect to the central axis of the closure body, the second rib portions of two diametrically opposite ribs being parallel to each other.

In a possible embodiment the closure has a pivotable lid connected to the body by means of a hinge, in particular a film hinge, wherein the groove is provided on the side of the closure body where the hinge is.

Preferably, the peripheral wall is provided with four ribs, consisting of two pairs of diametrically opposite ribs with respect to the central axis of the closure body.

The tamper-evident closure is typically manufactured from plastic material by means of injection moulding. The closure body and the pivotable lid are thus formed in one piece.

The invention furthermore relates to an assembly of a container and a tamper-evident closure as described in the above, wherein the container has a shoulder portion and a neck portion which defines a dispensing opening of the container, wherein recesses are provided in the shoulder portion of the container, in which the protrusions, or at least a portion thereof, are received.

The invention will be further described in detail with reference to the drawings.

DETAILED DESCRIPTION

Figure 1:
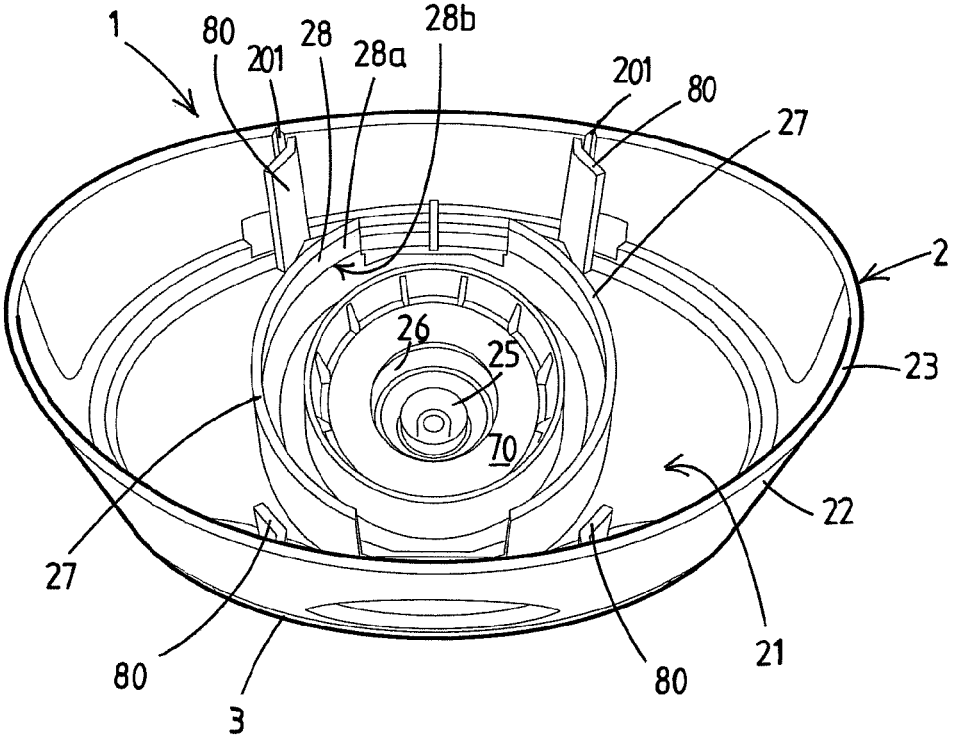
FIG. 1 shows a view in perspective from below of a preferred embodiment of a tamper evident closure according to the invention.
Figure 2:
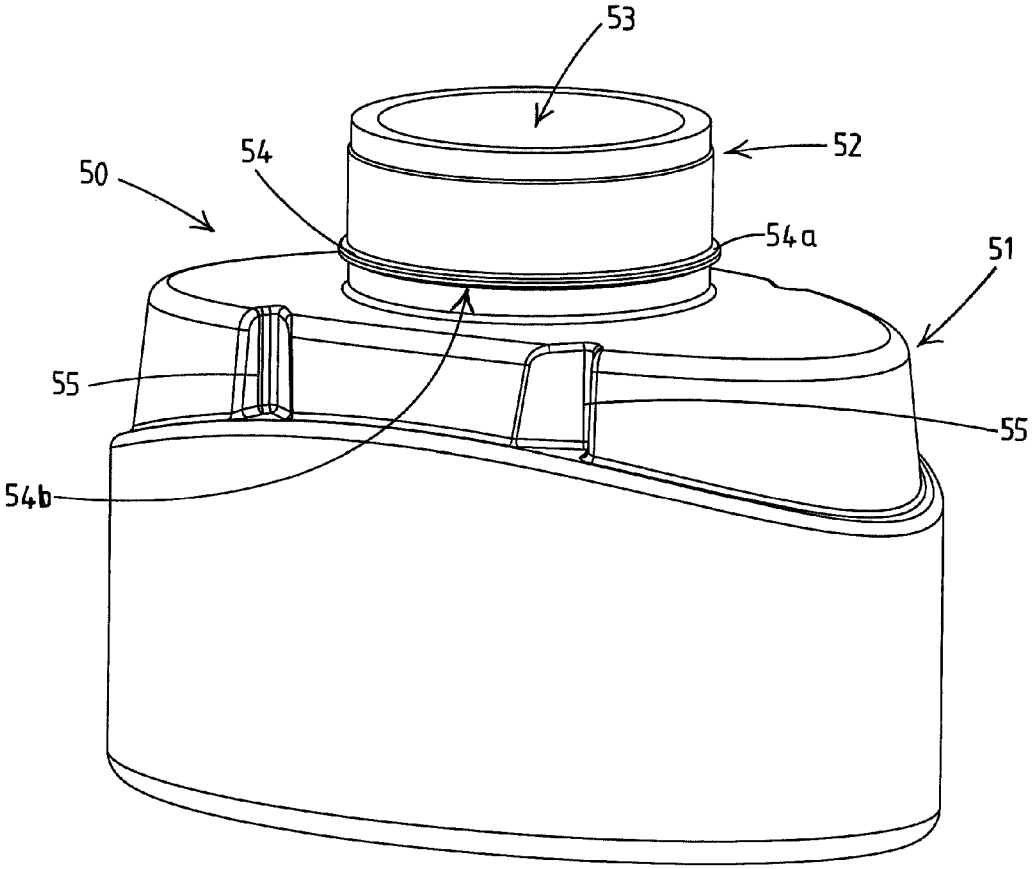
FIG. 2 shows a view in perspective of a container on which a tamper-evident closure of FIG. 1 can be fitted.

In FIG. 1 is shown a tamper evident closure 1. In the figure, which shows a view from below, mainly the inner side of the closure 1 is visible. The body 2 has a top wall 21 and a peripheral wall 22 that extends from the top wall 21 downwards. The peripheral wall 22 has a free lower end 23 which defines an open end of the closure body 2. The body 2 can be placed on top of a container 50 that is shown in FIG. 2 with this open end of the body 2. The container 50 may contain a substance, like foodstuffs such as ketchup, mayonnaise, mustard or other sauces, or like cosmetic products such as shampoo, bathing products, skin treatment products, etc. The top wall 21 has a dispensing passage 25, in this case defined by an upwardly extending collar 26, through which the substance can be dispensed from the container 50. In the dispensing passage a self-closing dispensing valve can be mounted, but this is not relevant for the present invention.

The closure 1 shown in FIG. 1 is of the type with a pivotable lid 3 which in a closed position covers the outer surface of the top wall 21. The pivotable lid 3 is connected with the closure body 2 by means of a film hinge (not shown) in a manner well know in the art. The closure body 2, the lid 3 and the hinge 4 are manufactured in one piece from plastic by means of injection moulding.

In FIG. 2 is shown the container 50, which on an upper side comprises a shoulder portion 51 and a neck portion 52 which defines a dispensing passage 53. On the outer surface of the neck portion a circumferential ring 54 is provided, which has a conical surface 54*a* facing upward (in the drawing) and a radial surface 54*b* facing downward.

The closure 1 has on the inside two opposed cylinder segments 27 which are positioned concentrically with the collar 26. The cylinder segments 27 extend from the top wall 21 downwards. At the lower end of the cylinder segments at the radially seen inner side, a ring segment 28 extends which has a conical surface 28*a* that faces downwards, i.e. towards the open end of the closure and a radial surface that faces upwards, i.e. towards the top wall 21.

On the top wall 21 is furthermore provided an inner cylindrical collar 29 which is concentrical with the cylinder segments 27. The collar 29 is located radially inward from the cylinder segments 27. The inner collar 29 extends in the same direction as the cylinder segments 27 but has a smaller length than the cylinder segments 27. In the collar 29 a sealing ring 70 is arranged.

When the closure 1 is placed on the container 50, the neck portion 52 of the container 50 is inserted into the space between the cylinder segments 27. The circumferential ring 54 is moved beyond the ring segments 28 on the cylinder segments whereby the a snap action takes place. During the locking movement the conical surfaces 28*a* and 54*a* slide over each other until the ring segments 28 snaps behind the circumferential ring 28 such that the radial surfaces 28*b* and 54*b* engage each other. The closure 1 is now locked on the container 50. In this state the end surface 52*a* of the container neck 52 abuts the sealing ring 70. The collar 29 surrounds the upper end portion of the container neck 52.

Figure 3:
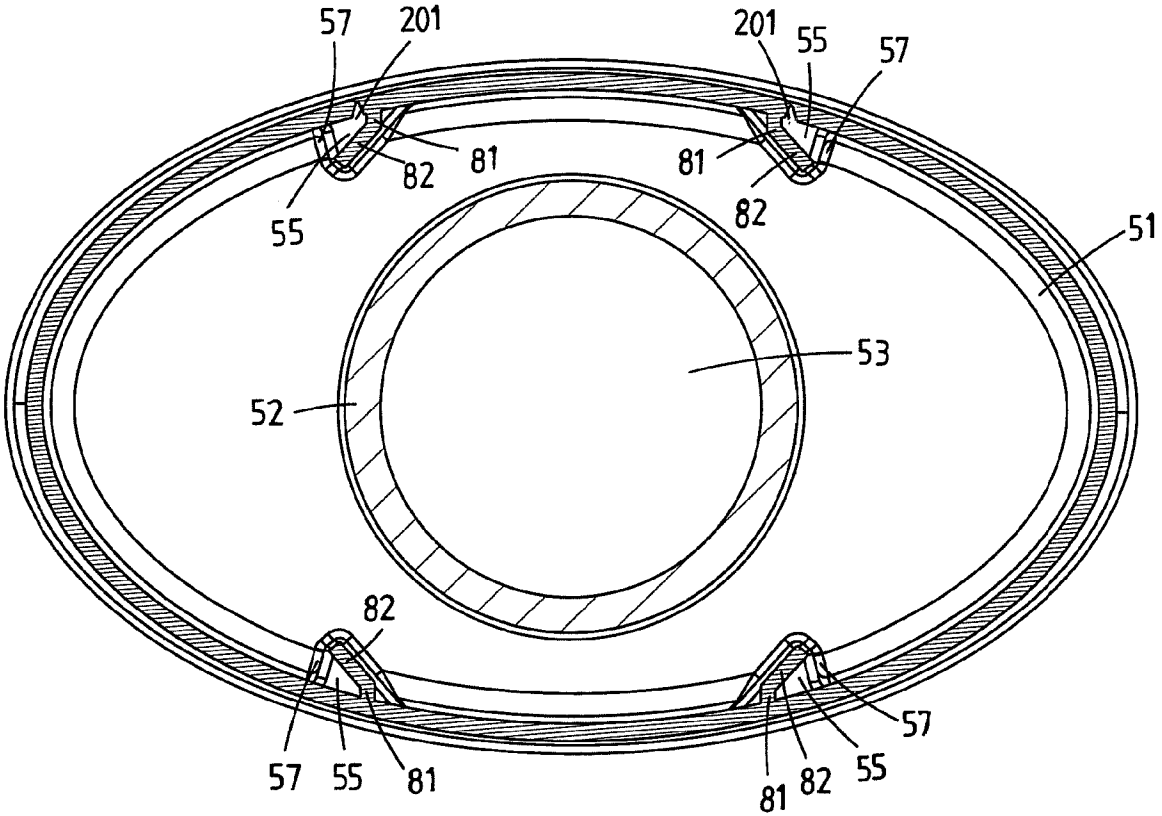
FIG. 3 shows an elevational view of the container of FIG. 2, on which the closure of FIG. 1 is mounted, which closure is show in a cross sectional view.

On the inner side of the peripheral wall 22 of the closure 1 four ribs 80 are provided as can be seen in FIG. 1. The ribs 80 have a first portion 81 that extends substantially perpendicular to the inner surface of the peripheral wall 22 as can be clearly seen in FIG. 3. The ribs 80 furthermore have a second portion 82 that extends obliquely with respect to the first portion. The angle between the two rib portions 81 and 82 is about 120° in the drawing, but may be between 90° and 180°. With respect to the central axis of the closure the ribs 80 are positioned equally distributed over the circumference of a virtual circle. The latter is however not necessary.

The shoulder portion 51 of the container 50 is provided with four recesses 55 formed as indents. Each recess 55 has a wall portion 56 that is substantially parallel with the second portion 82 of the corresponding rib 80. A wall portion 57 is present which forms a stop surface for the end edge of the second portion 82 of the rib 80.

Next to two of the ribs 80 a V-groove 201 is provided in the peripheral wall 22 of the closure 1. The groove 201 is provided on the side of the rib 80 to which the second rib portion 82 bends off with respect to the first rib portion 81. When a rotational force is applied to the closure 1 in attempt to lever the closure 1 from the container 50, the abutment surface against the wall 57 of the recess 55 in the shoulder 51. As the groove 201 is on the same side to which the second rib portion 82 is bent, the rotational force will spread open the groove, which eventually causes the peripheral wall 22 at the groove tip to be torn towards the outer side of the peripheral wall 22.

In the embodiment shown there are only provided grooves 201 at the rear side of the closure 1, i.e. that side where the hinge (not visible) for the pivotable lid 3 is arranged.

There are provided two grooves 201 which has the advantage that the peripheral wall 22 will tear regardless of what direction the closure is rotated with respect to the container. Either way, one of the grooves 201 will be spread open and cause a tear in the peripheral wall 22.

In the embodiment shown in the drawings, the closure body and the container have a essentially oval cross sectional shape. This must not be considered limiting as both the container as the closure body, may have another shape, such as for example circular, polygonal, rectangular or square.

In the preferred embodiment shown in the figures, the protrusions on the inner side of the peripheral wall are formed as ribs, in particular ribs with two legs. It must be noted however, that the protrusions could have another suitable shape as well. The protrusions could be formed as simple lugs that extend inwardly and do not extend over the entire height of the peripheral wall. Also the protrusions could be formed as ribs with another shape, not necessarily with the shape as shown in the preferred embodiment.

Also the weakening line is formed as V-groove in the preferred embodiment. It is however also conceivable to make weakening lines in another way. Actually it is only essential that a predetermined weak spot is created where the material will tear when the tension in the material is above a certain threshold.

The invention claimed is:

1. An assembly of a container and a tamper-evident closure, the container having a shoulder portion and a neck portion which defines a dispensing opening of the container; and the tamper-evident closure comprising:

a closure body that is permanently attached to the neck portion of the container by a snap lock connection, and a flip top lid that is pivotably connected to the closure body by a hinge, said closure body having:

a top wall provided with a dispensing passage which is in line with the dispensing opening of the container, and a peripheral wall which extends from the top wall towards a lower end, such that said lower end of the peripheral wall defines an open end of the closure body, said open end of the closure body being placed over the shoulder portion of the container;

wherein the flip top lid is pivotable between a closed position, in which it covers the top wall and the dispensing passage, to an open position, in which the flip top lid is pivoted away from the top wall and content of the container can be dispensed through the dispensing passage, wherein the shoulder portion of the container is provided with a recess and the peripheral wall of the closure body on an inner side thereof has a protrusion that projects inwardly, said protrusion being at least partially received in said recess of the shoulder portion of the container, the protrusion and recess cooperating to block a rotation of the closure with respect to the shoulder portion of the container, and wherein the peripheral wall on said inner side thereof next to said protrusion is provided with a weakening line causing the peripheral wall to rupture through towards an outer side of the peripheral wall to leave an inerasable mark on the outer side of the peripheral wall when a rotational force is applied to the closure in an attempt to remove the closure from the container.

2. The assembly according to claim 1, wherein the protrusion is formed as a rib which extends from the open end of the closure body towards the top wall of the closure body, the rib having a lower portion remote from the top wall, said lower portion being received in the recess.

3. The assembly according to claim 2, wherein the rib in cross section has a first portion that is substantially perpendicular with respect to the peripheral wall and a second portion that is bent away from the first portion.

4. The assembly according to claim 3, wherein the second portion of the rib extends in an angle with respect to the first portion of the rib between 90° and 180°.

5. The assembly according to claim 3, wherein the second portion of the rib extends under an angle with respect to the first portion of about 120°.

6. The assembly according to claim 3, wherein the peripheral wall is provided with a pair of diametrically opposite ribs with respect to the central axis of the closure body, the second rib portions of two diametrically opposite ribs being parallel to each other.

7. The assembly according to claim 3, wherein the weakening line is provided at that side of the rib to which also the second rib portion bends away.

8. The assembly according to claim 3, wherein the second portions of the ribs have an end edge which forms an abutment surface for abutting against a stop surface at the recess in the shoulder of the container.

9. The assembly according to claim 1, wherein the weakening line is formed as a groove on the inner side of the peripheral wall.

10. The assembly according to claim 1, wherein the weakening line is provided on the same side of the closure body where the hinge is located connecting the flip top lid to the closure body.

11. The assembly according to claim 1, wherein the peripheral wall is provided with four of said protrusions, consisting of two pairs of diametrically opposite protrusions with respect to the central axis of the closure body.

12. The assembly according to claim 1, wherein the closure is manufactured by means of injection moulding.

13. An assembly of a container and a tamper-evident closure, the container having a shoulder portion at an upper side thereof and a cylindrical neck portion extending from the shoulder portion, said neck portion defining a dispensing opening of the container, and said neck portion having a snap lock surface on an outer side thereof; and the tamper-evident closure comprising a closure body, said closure body having a top wall and a peripheral wall, said peripheral wall extending from an outer contour of the top wall towards a lower end, such that said lower end of the peripheral wall defines an open end of the closure body, said top wall being provided with a dispensing passage which is in line with the dispensing opening of the container, the closure body furthermore having a snap lock wall located radially inward from the peripheral wall and extending from the top wall, said snap lock wall having a snap lock surface on an inner side thereof that engages the snap lock surface of the neck portion so as to snap lock the closure body to the container;

wherein the shoulder portion is provided with a recess and the peripheral wall of the closure body on an inner side thereof has a protrusion that projects inwardly and that extends upwardly from the lower end of the peripheral wall, said protrusion being at least partially received in said recess of the shoulder portion of the container, the protrusion and recess cooperating to block a rotation of the closure with respect to the shoulder portion of the container, wherein the peripheral wall, next to said protrusion is provided with a weakening line that extends on the inner side of the peripheral wall upwardly from the lower end of the peripheral wall, causing the peripheral wall to rupture when a rotational force is applied to the closure in an attempt to remove the closure from the container thereby leaving an indication in the peripheral wall that the assembly of the container and the closure has been tampered with.

14. The assembly according to claim 13, wherein the closure has a pivotable lid connected to the closure body to cover the dispensing passage.

15. The assembly according to claim 13, wherein a self-closing dispensing valve is mounted in the dispensing passage.

16. An assembly of a container and a tamper-evident closure, the container having a shoulder portion at an upper side thereof and a cylindrical neck portion extending from the shoulder portion, said neck portion defining a dispensing opening of the container, and said neck portion having a snap lock surface on an outer side thereof; and the tamper-evident closure comprising a closure body, said closure body having a top wall and a peripheral wall, said peripheral wall extending from an outer contour of the top wall towards a lower end, such that said lower end of the peripheral wall defines an open end of the closure body, said top wall being provided with a dispensing passage which is in line with the dispensing opening of the container, the closure body furthermore having a snap lock wall located radially inward from the peripheral wall and extending from the top wall, said snap lock wall having a snap lock surface on an inner side thereof that engages the snap lock surface of the neck portion so as to snap lock the closure body to the container;

wherein the shoulder portion is provided with a stop surface and the peripheral wall of the closure body on an inner side thereof has a protrusion that projects inwardly, said protrusion having an abutment surface that abuts against the stop surface of the shoulder portion of the container, said abutment surface of the protrusion and said stop surface of the shoulder cooperating to block a rotation of the closure with respect to the shoulder portion of the container, wherein the peripheral wall on said inner side thereof next to said protrusion is provided with a weak spot causing the peripheral wall to rupture when a rotational force is applied to the closure in an attempt to remove the closure from the container thereby leaving an indication in the peripheral wall that the assembly of the container and the closure has been tampered with.

* * * * *